US009056691B2

(12) United States Patent
Mills et al.

(10) Patent No.: US 9,056,691 B2
(45) Date of Patent: Jun. 16, 2015

(54) BAG DEFLATION DEVICES AND METHODS FOR DEFLATING BAGS

(75) Inventors: Jason M. Mills, Fredonia, NY (US); Richard A. Schulte, Eureka, MO (US)

(73) Assignee: Nestec S.A., Vevey (CH)

( * ) Notice: Subject to any disclaimer, the term of this patent is extended or adjusted under 35 U.S.C. 154(b) by 1092 days.

(21) Appl. No.: 12/998,256

(22) PCT Filed: Oct. 15, 2009

(86) PCT No.: PCT/US2009/005639

§ 371 (c)(1), (2), (4) Date: May 18, 2011

(87) PCT Pub. No.: WO2010/047752

PCT Pub. Date: Apr. 29, 2010

(65) Prior Publication Data

US 2011/0214394 A1 Sep. 8, 2011

Related U.S. Application Data

(60) Provisional application No. 61/196,657, filed on Oct. 20, 2008.

(51) Int. Cl.
*B65B 3/18* (2006.01)
*B65B 31/04* (2006.01)
(Continued)

(52) U.S. Cl.
CPC ..... *B65B 31/041* (2013.01); *B65B 1/24* (2013.01); *B65B 1/20* (2013.01); *B65B 1/28* (2013.01); *B65B 51/146* (2013.01)

(58) Field of Classification Search
CPC .... B65B 9/2007; B65B 9/2049; B65B 61/24; B65B 3/18; B65B 1/24; B65B 7/06
USPC ..... 53/403, 405, 408, 469, 480, 481, 482, 53/79, 523, 526, 284.7, 512, 434; 269/3, 269/6, 95, 71, 75; 29/243.55
See application file for complete search history.

(56) References Cited

U.S. PATENT DOCUMENTS 2,915,866 A * 12/1959 Bartlo ..... 53/526
3,070,931 A 1/1963 Zwight
(Continued)

FOREIGN PATENT DOCUMENTS

EP 0276628 8/1988
GB 1315650 5/1973

OTHER PUBLICATIONS

International Search Report corresponding to related International Patent Application No. PCT/US2009/005639 mailed Dec. 9, 2009.
(Continued)

*Primary Examiner* — Stephen F Gerrity
*Assistant Examiner* — Joy N Sanders
(74) *Attorney, Agent, or Firm* — Julie M. Lappin; Aaron J. Morrow

(57) ABSTRACT

Bag deflating devices and methods of using the bag deflating devices are provided. In a general embodiment, the invention provides a bag deflating device comprising a first gripper and a first mechanical finger attached to the first gripper and constructed and arranged to move with the first gripper. The first mechanical finger comprises an elongated rod and a support plate attached to the elongated rod and defining at least one aperture. The bag deflating device further comprises a second gripper opposing the first gripper and a second mechanical finger attached to the second gripper and constructed and arranged to move with the second gripper. The second mechanical finger comprises an elongated rod and a support plate attached to the elongated rod and defining at least one aperture.

17 Claims, 4 Drawing Sheets

(51) Int. Cl.

| | |
|---|---|
| ***B65B 1/24*** | (2006.01) |
| ***B65B 1/28*** | (2006.01) |
| ***B65B 51/14*** | (2006.01) |
| *B65B 1/20* | (2006.01) |

(56) References Cited

U.S. PATENT DOCUMENTS

| | | | | | |
|---|---|---|---|---|---|
| 3,293,736 | A | * | 12/1966 | Tipper | 29/243.57 |
| 3,896,605 | A | * | 7/1975 | Chevalier | 53/570 |
| 4,221,101 | A | * | 9/1980 | Woods | 53/79 |
| RE30,893 | E | * | 4/1982 | Puchosic | 53/436 |
| 4,912,907 | A | | 4/1990 | Fang et al. | |
| 4,924,656 | A | | 5/1990 | Kovacs et al. | |
| 4,928,829 | A | * | 5/1990 | Di Bernardo | 206/524.8 |
| 5,014,493 | A | | 5/1991 | West | |
| 5,067,310 | A | * | 11/1991 | Yamanaka | 53/551 |
| 5,265,402 | A | | 11/1993 | Lerner et al. | |
| 5,699,730 | A | * | 12/1997 | Ogier et al. | 100/233 |
| 5,715,656 | A | | 2/1998 | Pearce | |
| 5,768,863 | A | * | 6/1998 | McGregor et al. | 53/570 |
| 5,930,983 | A | * | 8/1999 | Terminella et al. | 53/436 |
| 6,065,271 | A | * | 5/2000 | Nicastro | 53/570 |
| 6,662,532 | B1 | * | 12/2003 | Droog et al. | 53/459 |
| 7,748,201 | B2 | * | 7/2010 | Poppi | 53/551 |
| 8,402,724 | B2 | * | 3/2013 | Cecil et al. | 53/451 |
| 2003/0136092 | A1 | | 7/2003 | Taylor | |

OTHER PUBLICATIONS

International Written Opinion corresponding to related International Patent Application No. PCT/US2009/005639 mailed Dec. 9, 2009.

Supplementai European Search Report corresponding to related International Patent Application No. PCT/US2009/005639 dated May 31, 2012.

* cited by examiner

BAG DEFLATION DEVICES AND METHODS FOR DEFLATING BAGS

CROSS REFERENCE TO RELATED APPLICATIONS

This application is a national stage application under 35 U.S.C. §371 of PCT/US2009/005639 filed Oct. 15, 2009, which claims priority to U.S. Provisional Application Ser. No. 61/196,657 filed Oct. 20, 2008, the disclosures of which are incorporated herein by reference.

BACKGROUND OF THE INVENTION

1. Field of the Invention

The invention relates generally to methods and devices for packaging products and particularly to methods and devices for packaging products in bags while deflating the bag to remove unwanted headspace gases.

2. Description of the Related Art

Machines and devices for deflating packages are known in the art. U.S. Pat. No. 4,964,259 discloses a process and apparatus for forming, filling, sealing and deflating a package of goods prior to the time the fill opening is sealed includes a blast of air against the exterior flexible sidewalls of the package to thereby drive gas from the inside of the package. U.S. Pat. No. 5,210,995 discloses a machine for packaging objects, particularly containers comprising a frame having a conveyor belt and a pair of convergent tracks leading to a distributing means, at least two containers to be joined in a package, and means moving said containers towards a third track with vertically disposed reels feeding laminar material to opposite sides of the containers, and through cutting and thermowelding means which form the package for inserting it in the heating tunnel. U.S. Pat. No. 5,303,531 discloses a packaging apparatus and method for packaging objects in such a way as to ensure that the article will not be damaged. Objects to be packaged are gripped by a plurality of pairs of vertically oriented gripping fingers each having inflatable bladders therein. The inflated bladders engage the objects with a predetermined low pressure sufficient to grasp and secure the objects. The plurality of fingers with gripped objects are then moved to place the objects in packaging containers. A vacuum is drawn on the inflated bladders, releasing the objects into the packaging container. US2006120632A1 discloses a vacuum packaging bag wherein three edges of the bag are sealed and one edge is equipped with a concave-convex fastener. The bag is equipped with a deflating device. The deflating device consists of a base, a holding washer, a cover, and a sealing washer. The cover and the based are connected through screw threads. The base is placed inside the bag. The screw part of the base penetrates through one side of the bag. The holding washer fastens the film against the base. The sealing washer is placed on a support. The support is placed in the passageway between the base and the outside of the bag. The middle of the cover has a pressure post which is connected to the sealing washer. The middle of the pressure post has an opening to the outside of the bag. A deflating cylinder is used with the deflating device of the bag. The deflating cylinder is a piston cylinder. The front part of the piston rod has two holding boards. Between the holding boards there is a spacer. The backside board has a notch; the back part of the piston rod is connected to a pulling handle. On the front part of the cylinder is a convex. A pulling ring is attached to the convex. The vacuum packaging bag of the invention is simple in structure, easy to make, and convenient to use. It ensures the stored goods quality and value.

US2008209864A1 discloses a process for forming a pouch having an evacuated headspace containing a flowable material. The process includes the steps of: providing a continuous tube of flexible and sealable film; supplying the continuous tube with a predetermined amount of flowable material; pinching the continuous tube above a sealing region so as to form a pinched portion of the continuous tube; evacuating the headspace between the pinched portion and the predetermined amount of flowable material; and sealing the continuous tube at the sealing region to form a top seal of a previously formed pouch containing flowable material and a bottom seal of a next-to-be filled pouch. Also disclosed is a vertical form-fill-seal apparatus for forming a pouch containing a flowable material and having an evacuated headspace.

In a typical bagging operation, a bag having one open end enters a bag filling machine and is engaged by a transfer arm that grips the bag and opens the open end of the bag, typically by pinching the edge of the bag in close proximity to the open end of the bag. The transfer arm pinches the bag on both sides between gripper arms/blocks on the machine's transfer arm. The transfer arm then moves the bag such that a spout on the machine is in a position to fill product into the bag through the open end of the bag. Typically, the spout is surrounded by the open end of the bag.

Spout clamps on the spout engage the bag and hold the bag in a position to be filled with a product that flows from the spout into the bag. The gripper blocks release the bag and return a position to engage the next bag to be filled after the spout clamps engage the bags. The product is filled from the spout through the bag to a desired level. After the bag is filled, the machine transport arm having gripper blocks grips the bag using the gripper blocks and moves it away from the spout to an outfeed conveyor for further processing, e.g., sealing.

The problem with this operation is that the filled bag has air or other gases in the headspace above the product. This air expands the bag, opens gussets, and interferes with sealing and other process. Also, the air can be detrimental to the product, e.g., the air contains moisture that may facilitate microbial growth on the product. Further, the air can make the bag more difficult to handle, e.g., more difficult to palletize and place on the retail shelf. This problem is characteristic of bags, pouches and other similar containers. There is, therefore, a need for new bag deflation devices and methods useful for removing unwanted headspace gases from containers.

SUMMARY OF THE INVENTION

The invention is directed to bag deflating devices and methods of using the bag deflating devices to remove excess air from bags, containers, pouches, and the like. In a general embodiment, the invention provides a bag deflating device comprising a first gripper and a first mechanical finger attached to the first gripper and constructed and arranged to move with the first gripper. The first mechanical finger comprises an elongated rod and a support plate attached to the elongated rod and defining at least one aperture. The bag deflating device further comprises a second gripper opposing the first gripper and a second mechanical finger attached to the second gripper and constructed and arranged to move with the second gripper. The second mechanical finger comprises an elongated rod and a support plate attached to the elongated rod and defining at least one aperture.

In an embodiment, the elongated rod has a length of about 10 inches and a width of about 0.375 inches.

In an embodiment, the support plate is in the shape of a rectangle have a length of about 2 inches and a width of about 1.125 inches.

In an embodiment, the mechanical gripper comprises a single unitary piece.

In an embodiment, the mechanical gripper comprises one or more materials such as metals, woods, plastics, polymers, composites or combination thereof In another embodiment, the invention provides an assembly comprising a bagging machine having a bag deflating device. The deflating device comprises a first gripper and a first mechanical finger attached to the first gripper and constructed and arranged to move with the first gripper. The deflating device also comprises a second gripper opposing the first gripper and a second mechanical finger attached to the second gripper and constructed and arranged to move with the second gripper.

In an embodiment, the first mechanical finger comprises an elongated rod and a support plate attached to the elongated rod and defining at least one aperture.

In an embodiment, the second mechanical finger comprises an elongated rod and a support plate attached to the elongated rod and defining at least one aperture.

In an alternative embodiment, the invention provides a method for deflating a bag. The method comprises providing a bag deflating device comprising 1) a first gripper and a first mechanical finger attached to the first gripper and constructed and arranged to move with the first gripper, and 2) a second gripper opposing the first gripper and a second mechanical finger attached to the second gripper and constructed and arranged to move with the second gripper. The method further comprises filling a bag with a product and compressing a portion of the bag between the first mechanical finger and the second mechanical finger to deflate the bag.

In an embodiment, the method further comprises sealing an opening of the bag after the bag is deflated.

In an embodiment, the bag deflating device is incorporated as part of a bagging machine.

In another embodiment, the invention provides a method for making a product package. The method comprises providing a bag deflating device comprising 1) a first gripper and a first mechanical finger attached to the first gripper and constructed and arranged to move with the first gripper, and 2) a second gripper opposing the first gripper and a second mechanical finger attached to the second gripper and constructed and arranged to move with the second gripper. The method further comprises filling a bag with a product and compressing a portion of the bag between the first mechanical finger and the second mechanical finger to deflate the bag. An opening of the bag can be sealed to form the product package.

In an embodiment, the product comprises a pet food.

An advantage of the invention is to provide a device for removing excess air or other gases from the headspace of bags. Another advantage of the invention is to provide a packaging assembly for removing air or other gases from the headspace of bags. Yet another advantage of the invention is to a method for removing excess air or other gases from the headspace of bags during the manufacture of packaged products. Still another advantage of the invention is to provide an improved package have little excess air within the package.

Additional features and advantages are described herein, and will be apparent from the following Detailed Description and the figures.

DETAILED DESCRIPTION OF THE INVENTION

The invention provides bag deflating devices and methods of using the bag deflating devices. For example, the bag deflating devices are suitable for removing unwanted air or other gases from the headspace of bags during the packaging filling process.

Typical bagging machines allow for air to become trapped in the bag during a filling and transfer operation. The air in the bag prevents the sealing operation from taking place in a reliable and consistent fashion. This results in increased bag jams and bag folds that are out of specification thus decreasing production. Embodiments of the invention conveniently remove the excess air of the bags, which improves the bag filling process and results in a more efficiently packaged product.

Figure 1:
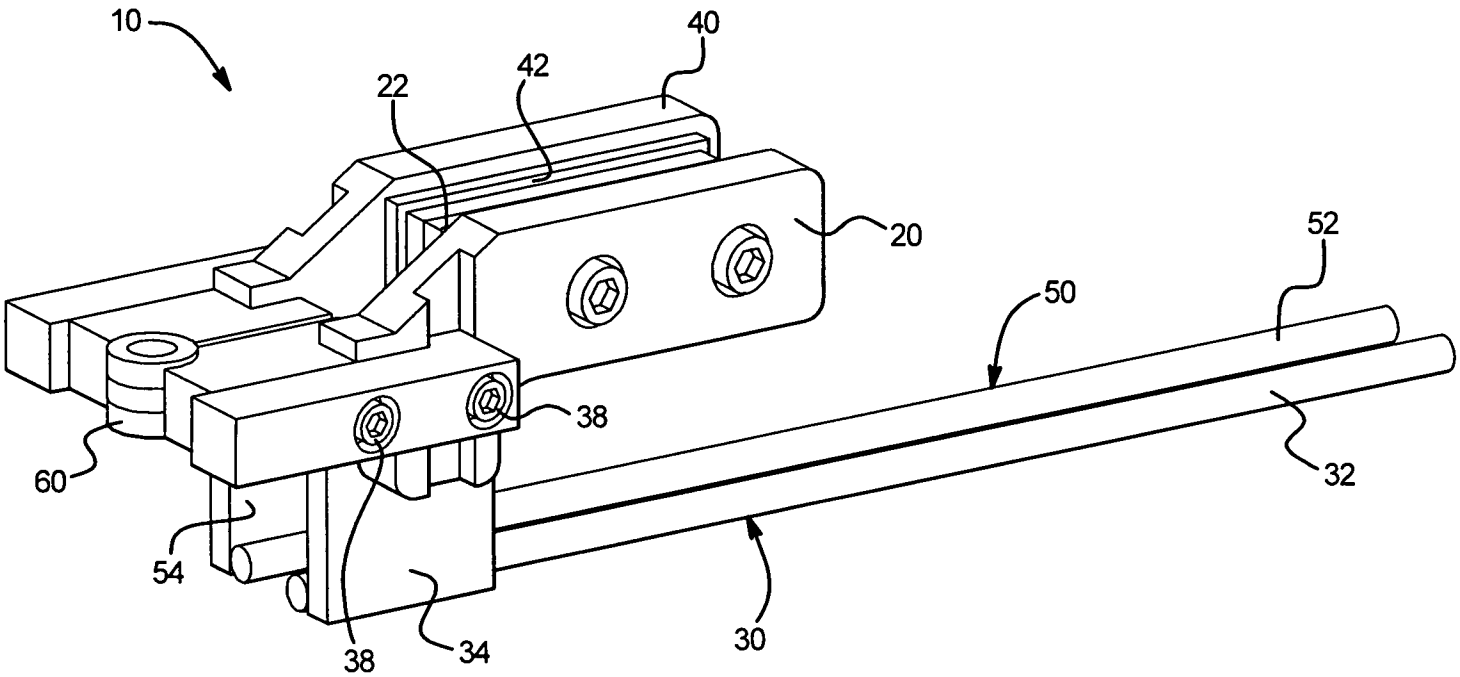
FIG. 1 illustrates a front perspective view of the bag deflating device in a closed position in an embodiment of the invention.
Figure 2:
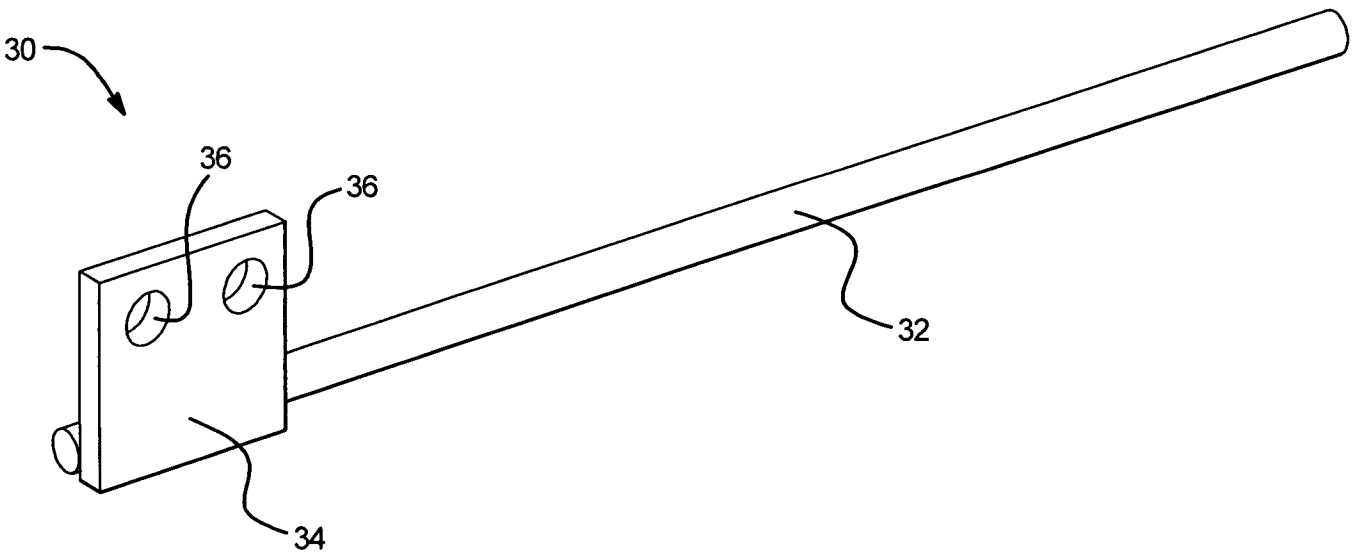
FIG. 2 illustrates a front perspective view of the mechanical finger in an embodiment of the invention.
Figure 3:
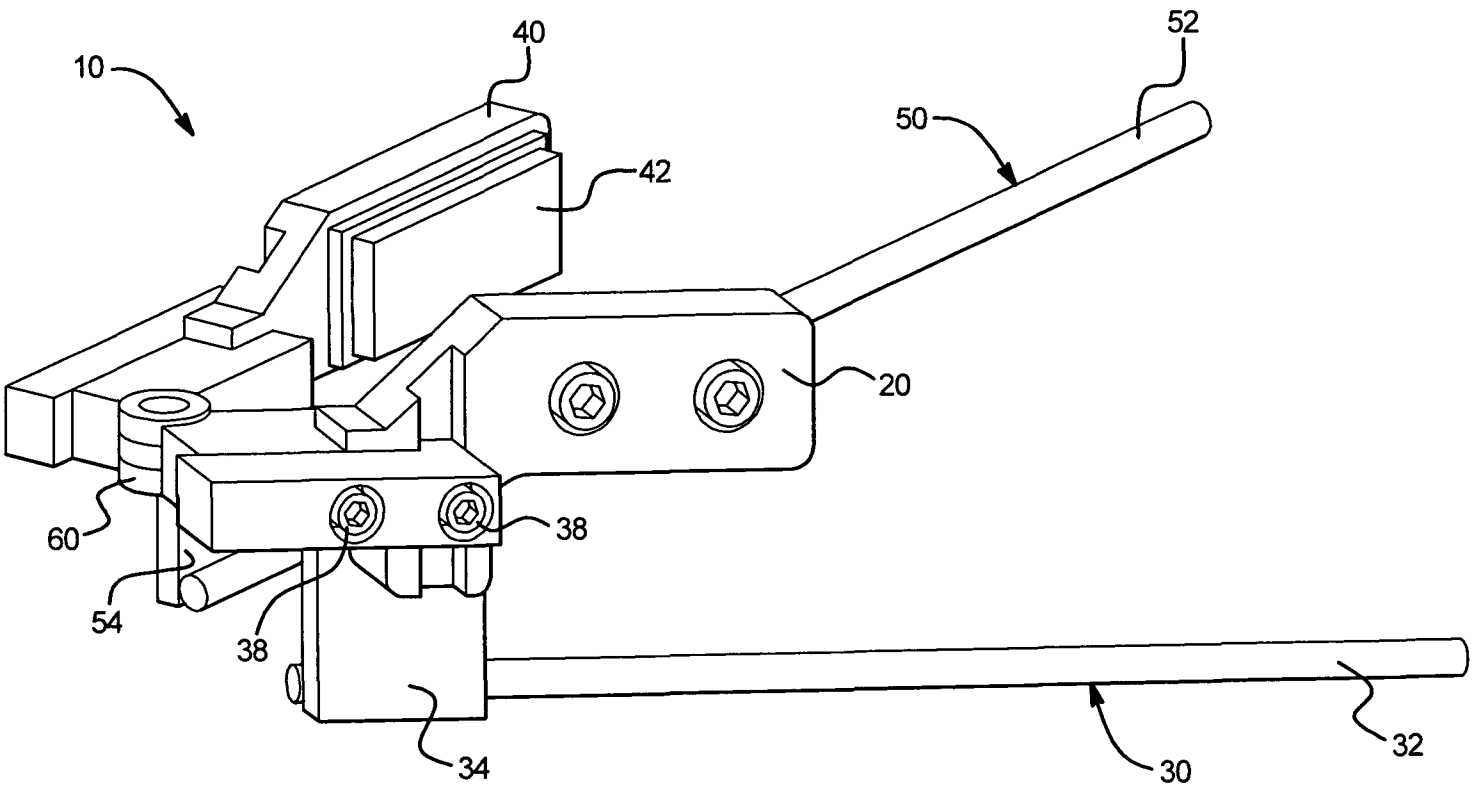
FIG. 3 illustrates a front perspective view of the bag deflating device in an open position in an embodiment of the invention.

In a general embodiment shown in FIGS. 1-3, the invention provides a bag deflating device 10 comprising a first gripper 20 and a first mechanical finger 30 attached to the first gripper 20 and constructed and arranged to move with the first gripper 20. The first mechanical finger 30 comprises an elongated rod 32 and a support plate 34 attached to the elongated rod 32 and defining one or more apertures 36. The support plate 34 can be constructed and arranged to be attached to any suitable gripper device or gripper block on a bagging machine.

The first mechanical finger 30 can be attached to the first gripper 20 using any suitable fastening mechanism such as, for example, one or more screws 38. The screws 38 are constructed and arranged to pass through the apertures 36 to attach the first mechanical finger 30 to the first gripper 20.

The bag deflating device 10 further comprises a second gripper 40 opposing the first gripper 20 and a second mechanical finger 50 attached to the second gripper 40 and constructed and arranged to move with the second gripper 40. The second mechanical finger 50 comprises an elongated rod 52 and a support plate 54 attached to the elongated rod 52 and defining one or more apertures. The first gripper 20 and the second gripper 40 can also comprise pads 22 and 42, respectively, to assisting in holding or gripping a package between the first and second grippers 20 and 40.

The second gripper 40 can rotate toward the first gripper 20 around a pivot point 60. Any suitable mechanical/electrical motor can be used to move the first gripper 20 and second gripper 40 toward and away from each other.

The second mechanical finger 50 can be attached to the second gripper 40 using any suitable fastening mechanism such as, for example, one or more screws. The screws are constructed and arranged to pass through the apertures to attach the second mechanical finger 50 to the first gripper 40.

The mechanical fingers can have an elongated rod comprising any suitable length and thickness. In an embodiment, the elongated rod has a length of about 10 inches and a width/diameter of about ⅜ inches. The elongated rod can be in the shape of an elongated cylinder.

During operation, the mechanical fingers can be oriented so that the mechanical fingers contact a filled bag above the product level and force excess air or gas from the bag. Generally, the mechanical fingers can apply pressure to the outside of the bag and force excess air or gas out of the bag as the grippers extend to engage the bag and remove it from a filler spout on the bagging machine. In an embodiment, the mechanical fingers can extend past the grippers to just less that half the width of the bag. In another embodiment, a two pair of bag deflating devices facing each other can be used in concert on both sides of the bag to grip the bag with the grippers and deflate the bag with the mechanical fingers.

The support plate can have any suitable size and shape for attaching to the gripper. In an embodiment, the support plate is in the shape of a rectangle have a length of about 2 inches and a width of about 1.125 inches.

In an embodiment, the mechanical grippers comprise a single unitary piece. For example, the elongated rod and the support plat can comprise a single unitary piece made by a molding process. Alternatively, the elongated rod can be separately attached to the support plate using any suitable method (e.g. fasteners, adhesive, welding, etc.). The mechanical grippers can be made from any one or more suitable rigid or semi-rigid materials such as metals, woods, plastics, polymers (e.g. Teflon), composites or combinations thereof. In an embodiment, the material should be rigid enough to withstand deformation that could be caused by compressing a bag having varying levels of product in the bag.

In another embodiment, the invention provides an assembly comprising a bagging machine having a bag deflating device. The assembly can be any suitable manufacturing assembly that fills one or more bags with products such as, for example, food or pet food. The deflating device comprises a first gripper and a first mechanical finger attached to the first gripper and constructed and arranged to move with the first gripper. The deflating device also comprises a second gripper opposing the first gripper and a second mechanical finger attached to the second gripper and constructed and arranged to move with the second gripper.

The bagging machine can be any suitable bag filling machine known by the skilled artisan. For example, the bagging machine can have the capabilities to form, fill and seal shut packages, bags or containers to provide a packaged product. Representative non-limiting examples of suitable bagging machines are made by Premier Tech Company, particularly their machines for bagging pet foods.

In an alternative embodiment, the invention provides a method for deflating a bag. The method comprises providing a bag deflating device comprising 1) a first gripper and a first mechanical finger attached to the first gripper and constructed and arranged to move with the first gripper, and 2) a second gripper opposing the first gripper and a second mechanical finger attached to the second gripper and constructed and arranged to move with the second gripper.

Figure 4:
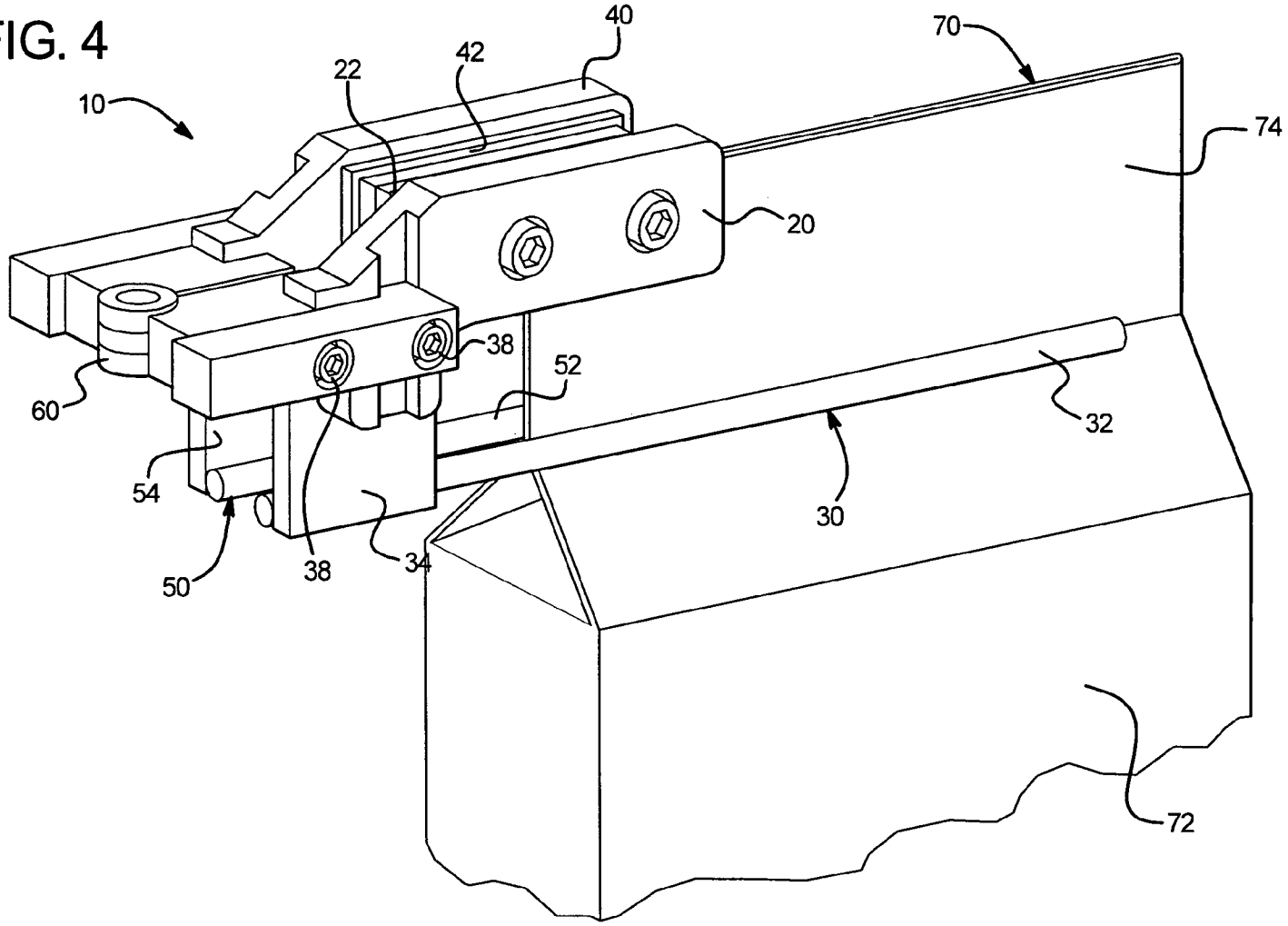
FIG. 4 illustrates a front perspective view of the bag deflating device compressing a bag in an embodiment of the invention.

The method further comprises filling a bag with a product and compressing a portion of the bag between the first mechanical finger and the second mechanical finger as illustrated in FIG. 4. This evacuates air in the bag before sealing the bag. For example, as the first and second grippers come together to grab the bag from a filling station, the corresponding first and second mechanical fingers contact the bag below the first and second grippers. As a result, the first and second mechanical fingers squeeze or compress the filled bag to eliminated excessive air from the bag above the product line level.

The mechanical fingers can extend for any suitable length such as, for example, about 4 inches past the grippers. The mechanical fingers can contact any suitable portion such as most of the whole width of the bag.

In another embodiment, the method can comprise using two pair of bag deflating devices that are facing each other to remove excess air from filled bags. As the grippers take hold of both sides of the bag, the pair of mechanical fingers can extend past the grippers and contact most of the width of the bag from either side, for example, except for about 0.5 inches of the center of the bag itself. The mechanical fingers can extend for any suitable length past the grippers and may even extend past the mechanical fingers extending from the opposite side of the bag. By removing excess air from the bags, these bag deflating device configurations can prevent machine jams and undesirable folds.

Preferably, the mechanical fingers extend to cover most of the bag width. In an embodiment, the ratio of the mechanical finger length (total) to bag width ranges from about 0.1 to about 0.95. In another embodiment, the ratio of the mechanical finger length (total) to bag width ranges from about 0.25 to about 0.8. In an alternative embodiment, the ratio of the mechanical finger length (total) to bag width ranges from about 0.33 to about 0.66.

In an embodiment, the method further comprises sealing an opening of the bag after the bag is deflated. In another embodiment, the bag deflating device is incorporated as part of a bagging machine. The bagging machine can be, for example, a Premier Tech® bagging machine that is retrofitted the bag deflating device in embodiments of the invention.

In another embodiment, the invention provides a method for making a product package. The method comprises providing a bag deflating device comprising 1) a first gripper and a first mechanical finger attached to the first gripper and constructed and arranged to move with the first gripper, and 2) a second gripper opposing the first gripper and a second mechanical finger attached to the second gripper and constructed and arranged to move with the second gripper. The method further comprises filling a bag with a suitable product and compressing a portion of the bag between the first mechanical finger and the second mechanical finger to deflate the bag. After being deflated, the bag's opening can be sealed to form the product package. The product is any product suitable for packaging into bags, particularly those that deteriorate when exposed to headspace gases. In various embodiments, the product is a food, fertilizer, food ingredient, or cereal. In a preferred embodiment, the product is a pet food, most preferably a dry pet food.

As used herein, ranges are used herein in shorthand, so as to avoid having to list and describe each and every value within the range. Any appropriate value within the range can be selected, where appropriate, as the upper value, lower value, or the terminus of the range.

As used herein, the singular form of a word includes the plural, and vice versa, unless the context clearly dictates otherwise. Thus, the references "a", "an", and "the" are generally inclusive of the plurals of the respective terms. For example, reference to "a device", "a method", or "a food" includes a plurality of such "devices", "methods", or "foods." Similarly, the words "comprise", "comprises", and "comprising" are to be interpreted inclusively rather than exclusively. Likewise the terms "include", "including" and "or" should all be construed to be inclusive, unless such a construction is clearly prohibited from the context. Similarly, the term "examples," particularly when followed by a listing of terms, is merely exemplary and illustrative and should not be deemed to be exclusive or comprehensive.

The methods and compositions and other advances disclosed here are not limited to particular methodology, protocols, and materials described herein because, as the skilled artisan will appreciate, they may vary. Further, the terminology used herein is for the purpose of describing particular embodiments only, and is not intended to, and does not, limit the scope of that which is disclosed or claimed.

Unless defined otherwise, all technical and scientific terms, terms of art, and acronyms used herein have the meanings commonly understood by one of ordinary skill in the art in the field(s) of the invention, or in the field(s) where the term is used. Although any compositions, methods, articles of manufacture, or other means or materials similar or equivalent to those described herein can be used in the practice of the invention, the preferred compositions, methods, articles of manufacture, or other means or materials are described herein.

In the specification, there have been disclosed typical preferred embodiments of the invention. Although specific terms are employed, they are used in a generic and descriptive sense only and not for purposes of limitation. The scope of the invention is set forth in the claims. Obviously many modifications and variations of the invention are possible in light of the above teachings. It is therefore to be understood that within the scope of the appended claims, the invention may be practiced otherwise than as specifically described.

What is claimed is:

1. A bag deflating device comprising:

a first gripper having a first end and a second end opposite to the first end;

a first mechanical finger attached to the first gripper and constructed and arranged to move with the first gripper, the first mechanical finger comprising an elongated rod and a support plate attached to the elongated rod and defining at least one aperture;

a second gripper opposing the first gripper, having a first end and a second end opposite to the first end, and the first end of the first gripper is pivotally connected to the first end of the second gripper such that the second ends pivot toward each other and away from each other; and a second mechanical finger attached to the second gripper and constructed and arranged to move with the second gripper, the second mechanical finger comprising an elongated rod and a support plate attached to the elongated rod and defining at least one aperture, the first and second grippers are configured to hold a bag by gripping a first portion of the bag, the holding of the bag between the first and second grippers comprises rotating the first and second grippers toward each other to grip the first portion of the bag between the first and second grippers, the first and second mechanical fingers are configured to compress a second portion of the bag between the first mechanical finger and the second mechanical finger to deflate the bag, and the second portion of the bag is lower on the bag relative to the first portion of the bag.

2. The bag deflating device of claim 1 wherein the first and second grippers pivot on an axis of rotation, and the elongated rod of the first mechanical finger and the elongated rod of the second mechanical finger each extend perpendicularly from the axis of rotation.

3. The bag deflating device of claim 1 wherein the elongated rod of the first mechanical finger is connected to the support plate of the first mechanical finger at a first end of the elongated rod of the first mechanical finger, the elongated rod of the second mechanical finger is connected to the support plate of the second mechanical finger at a first end of the elongated rod of the second mechanical finger, and pivoting the first gripper relative to the second gripper pivots a second end of the elongated rod of the first mechanical finger toward and away from a second end of the elongated rod of the first mechanical finger.

4. The bag deflating device of claim 3 wherein the elongated rod of the first mechanical finger has a length that extends along the first gripper and is defined between the first and second ends, and the elongated rod of the second mechanical finger has a length that extends along the second gripper and is defined between the first and second ends.

5. The bag deflating device of claim 1 wherein the support plate of the first mechanical finger is attached to the first gripper to pivot with the first gripper, and the support plate of the second mechanical finger is attached to the second gripper to pivot with the second gripper.

6. An assembly comprising:

a bagging machine having a bag deflating device comprising:

a first gripper;

a first mechanical finger attached to the first gripper and constructed and arranged to move with the first gripper;

a second gripper opposing the first gripper and pivotally connected to the first gripper; and a second mechanical finger attached to the second gripper and constructed and arranged to move with the second gripper, the first and second grippers are configured to hold a bag by gripping a first portion of the bag, the holding of the bag between the first and second grippers comprises rotating the first and second grippers toward each other to grip the first portion of the bag between the first and second grippers, the first and second mechanical fingers are configured to compress a second portion of the bag between the first mechanical finger and the second mechanical finger to deflate the bag, and the second portion of the bag is lower on the bag relative to the first portion of the bag.

7. The assembly of claim 6 wherein the first mechanical finger comprises an elongated rod and a support plate attached to the elongated rod and defining at least one aperture.

8. The assembly of claim 6 wherein the second mechanical finger comprises an elongated rod and a support plate attached to the elongated rod and defining at least one aperture.

9. A method for deflating a bag comprising:

providing a bag deflating device comprising 1) a first gripper and a first mechanical finger attached to the first gripper and constructed and arranged to move with the first gripper, and 2) a second gripper opposing the first gripper and a second mechanical finger attached to the second gripper and constructed and arranged to move with the second gripper;

filling a bag with a product;

holding the bag between the first and second grippers by gripping a first portion of the bag, the holding of the bag between the first and second grippers comprises rotating the first and second grippers toward each other to grip the first portion of the bag between the first and second grippers; and compressing a second portion of the bag between the first mechanical finger and the second mechanical finger to deflate the bag, and the second portion of the bag is lower on the bag relative to the first portion of the bag.

10. The method of claim 9 wherein the first mechanical finger comprises an elongated rod and a support plate attached to the elongated rod and defining at least one aperture, and the compressing of the second portion of the bag comprises pivoting the elongated rod.

11. The method of claim 9 wherein the second mechanical finger comprises an elongated rod and a support plate attached to the elongated rod and defining at least one aperture and the compressing of the second portion of the bag comprises pivoting the elongated rod.

12. The method of claim 9 wherein the bag deflating device is incorporated as part of a bagging machine.

13. A method for making a product package comprising:

providing a bag deflating device comprising 1) a first gripper and a first mechanical finger attached to the first gripper and constructed and arranged to move with the first gripper, and 2) a second gripper opposing the first gripper and a second mechanical finger attached to the second gripper and constructed and arranged to move with the second gripper;

filling a bag with a product;

holding the bag between the first and second grippers by gripping a first portion of the bag, the holding of the bag between the first and second grippers comprises rotating the first and second grippers toward each other to grip the first portion of the bag between the first and second grippers; and compressing a second portion of the bag between the first mechanical finger and the second mechanical finger to deflate the bag, the second portion of the bag is lower on the bag relative to the first portion of the bag, and the compressing of the second portion of the bag comprises pivoting the first and second mechanical fingers relative to each other.

14. The method of claim 13 wherein the first mechanical finger comprises an elongated rod and a support plate attached to the elongated rod and defining at least one aperture, and the compressing of the portion of the bag comprises contacting the portion of the bag with the elongated rod.

15. The method of claim 13 wherein the second mechanical finger comprises an elongated rod and a support plate attached to the elongated rod and defining at least one aperture, and the compressing of the portion of the bag comprises contacting the portion of the bag with the elongated rod.

16. The method of claim 13 wherein the bag deflating device is incorporated as part of a bagging machine.

17. The method of claim 13 wherein the product comprises a pet food.

* * * * *